United States Patent [19]

Burton

[11] 3,983,665

[45] Oct. 5, 1976

[54] FOLDABLE AND TRANSPORTABLE HOME

[75] Inventor: Keith O. Burton, Elkhart, Ind.

[73] Assignee: BurKin Homes Corporation, White Pigeon, Mich.

[22] Filed: Sept. 24, 1975

[21] Appl. No.: 616,428

[52] U.S. Cl. ..... 52/71; 52/79; 52/90

[51] Int. Cl.[2] ..... E04B 7/16

[58] Field of Search ..... 52/64, 67, 66, 70, 71, 52/68, 79, 90

[56] References Cited

UNITED STATES PATENTS

| | | | |
|---|---|---|---|
| 1,404,963 | 1/1922 | Hyde | 52/618 |
| 3,638,373 | 2/1972 | Chapman | 52/79 |
| 3,653,165 | 4/1972 | West | 52/67 |
| D224,218 | 7/1972 | Kelbish | 52/79 |

*Primary Examiner*—John E. Murtagh
*Attorney, Agent, or Firm*—Marmaduke Hobbs

[57] ABSTRACT

A foldable and transportable home having side walls, foldable end walls and foldable roof sections, which, in their unfolded condition, form a saw-tooth configuration building structure. The two end walls have an upper and a lower portion, the upper portion being hinged to the lower portion and folding inwardly and downwardly. The roof includes two lower and two upper longitudinal roof sections forming a gable configuration, with the two upper sections being hinged to the respective lower roof sections and foldable downwardly relative thereto. The home may be in two longitudinal sections which can be separated from one another for transporting on an undercarriage and which may be removed therefrom when the home is placed in a permanent location.

12 Claims, 9 Drawing Figures

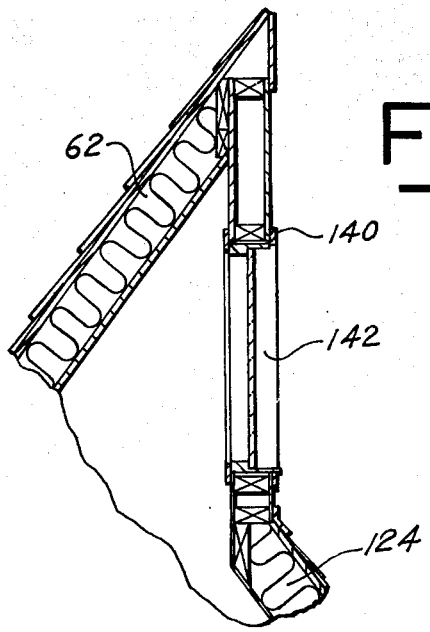
Fig. 4
Fig. 6
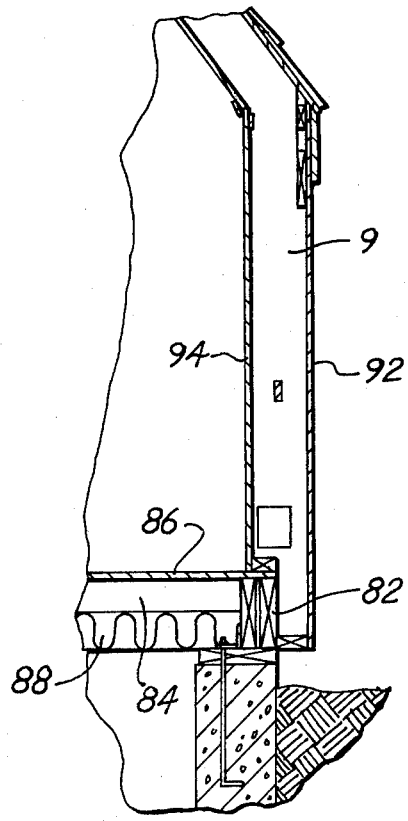
Fig. 5
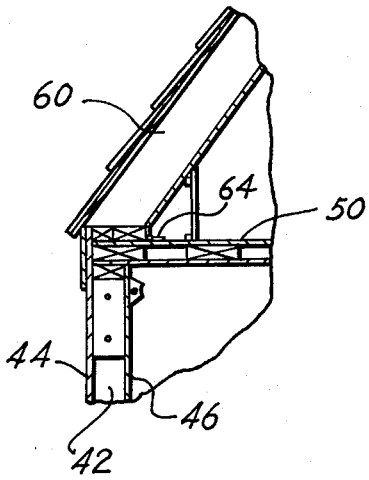

FOLDABLE AND TRANSPORTABLE HOME

In transportable homes such as mobile homes, the trend has been primarily to construct them larger in both length and width, and to include tip-out sections, and in some instances to make them expandable or to make them double-wide or modular in two main longitudinal sections which are transported separately and placed side-by-side when they are assembled for use. In most of these prior attempts to provide increased living space, the basic design and appearance have been that of a trailer or similar vehicle, with the final lines or silhouette resembling the conventional trailer on which only refinements have been generally made. With one principal exception, as evidence by U.S. Pat. No. 3,617,086, these portable homes rarely have the appearance of a conventional home, and notwithstanding the fact that the homes are used most of the time as permanent structures at fixed locations, little consideration has been given to a final structure having the appearance of a conventional home in a natural setting. The trailer's appearance is particularly noticeable and equally unattractive and unsightly when the mobile home is placed in a natural setting of a conventional home, and there is little improvement in the general appearance even in modern mobile home parks. The trailer appearance has been maintained primarily in order to render the vehicle suitable for movement on highways and streets, consistent with normal traffic flow patterns, even though the home will rarely be transported, and will usually be mounted on a stationary under-structure or foundation at a home site, and thereafter used as a normal home for extended periods of time, possibly for the rest of the life of the structure. With the one primary exception mentioned above, the attempts which have been made to make the mobile homes expandable into large structures, have resulted in structures still resembling a vehicular, box-like configuration. It is therefore one of the principal objects of the present invention to provide a foldable and transportable home which has the distinct appearance of a conventional home, lodge or cottage, yet which can be folded into a compact structure and moved conventiently on a highway as a normal trailer or conventional mobile home.

Another object of the invention is to provide a foldable and portable home or house which, when unfolded, has the appearance of an attractive lodge or house usable as a conventional home, and which may be folded and mounted on an undercarriage to permit it to be moved easily from place to place in its folded condition with furniture and other living appurtenances contained therein.

Still another object of the invention is to provide a foldable and transportable home of the aforementioned type, which will fold into a size which can readily be maneuvered into various positions and easily be towed by a truck or tractor, and thereafter used on the undercarriage or mounted on a permanent foundation or other suitable under-structure.

A further object is to provide a foldable home which will be double-wide or modular, and is, in effect, a two-story structure when in its unfolded condition, and which will fold into a structure which can be transported on conventional highways with no interference from standard overpasses, and thereafter can be unfolded and assembled in a short period of time with the use of standard equipment and tools.

Additional objects and advantages of the present invention will become apparent from the following description and accompanying drawings, wherein:

FIG. 4 is a fragmentary vertical cross sectional view of the home shown in the previous figures, the portion in section being indicated by circle 4 in FIG. 3;

FIG. 5 is a fragmentary vertical cross sectional view of the home shown in the previous figures, the portion being indicated by circle 5 in FIG. 3;

FIG. 6 is a fragmentary vertical cross sectional view of the home shown in the previous figures, the portion being indicated by circle 6 in FIG. 3;

Figure 1:
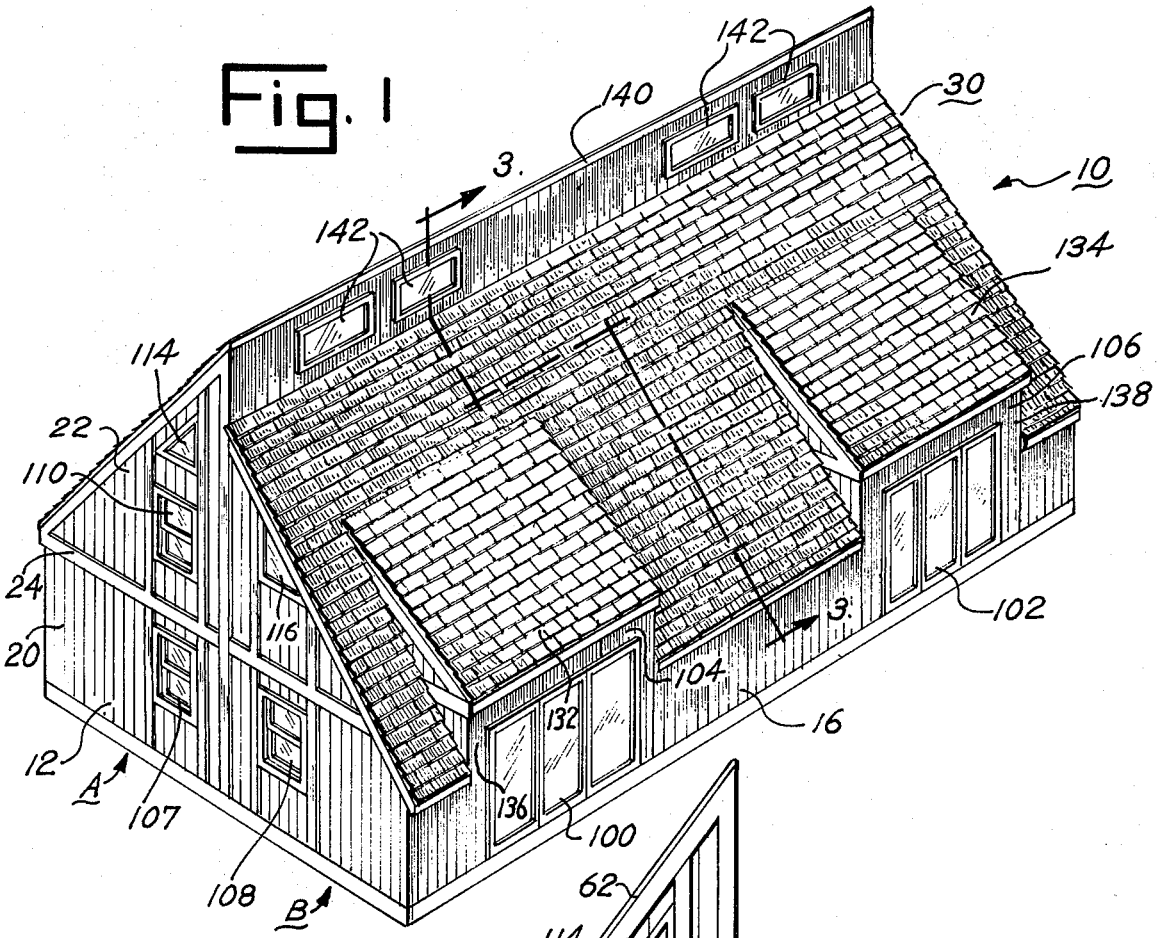
FIG. 1 is a perspective view of the present foldable and transportable home showing the home in its assembled condition ready for occupancy.
Figure 2:
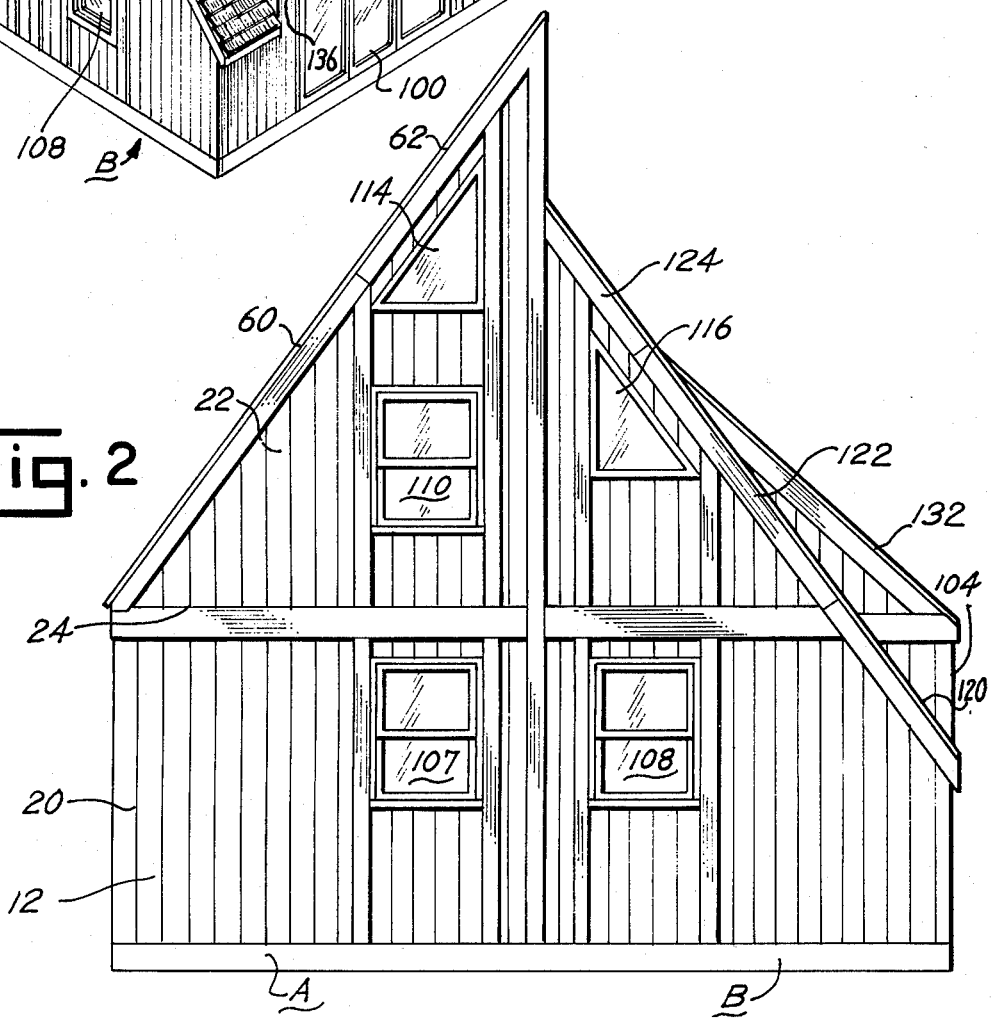
FIG. 2 is an end elevational view of the foldable and transportable home shown in FIG. 1.

Referring more specifically to the drawings, and to FIG. 1 in particular, numeral 10 indicates generally the present portable foldable and transportable home having end walls 12 and 14, and side walls 16 and 18, the two end walls and the two side walls being joined rigidly together to form a rigid body in the fully assembled home. The two end walls have a lower portion 20 and an upper portion 22, the upper portion being hinged at numeral 24 for folding inwardly from the vertical position shown in the drawings to a substantially horizontal position under the roof indicated generally by numeral 30. The home is divided into longitudinal sections A and B with the two sections being rigidly joined together when the home is fully assembled, and being separable for folding and transporting of the home. When the home has been assembled, the two sections form an integral unit for occupancy.

In the embodiment of the present invention illustrated in the drawings, section A consists of side wall 18, approximately one half of end walls 12 and 14, and the respective half of roof 30, the lower portion 20 of the end walls being joined rigidly to side wall 18 and the upper portion 22 of the two walls being hinged to fold inwardly and downwardly. Thus, each section is normally the width of a conventional mobile home, such as twelve or fourteen feet wide, and extends the full length of the home, which may normally be forty to sixty feet. For transporting, the section is placed on an undercarriage, with or without a separate frame, and is normally removed from the undercarriage when the home is assembled in its final location. The section has longitudinal perimeter beams 32 and 34 connected by a plurality of cross members 36 for supporting floor 38. Insulating material 40 may be used in the floor between the cross members, and the frame formed by the longitudinal beams and the cross members forms a rigid floor structure. The side walls are constructed of a plurality of spaced studding 42 supporting outside wall 44 and inside wall 46. A second or upper floor 50 may extend the full length of section A and is supported on one side by side wall 18 and on the other side by either a wall, post or studding 52. A railing 54 is attached to the inner edge of floor 50 and extends upwardly therefrom, forming a partially enclosed upstairs room indicated by numeral 56. The railing may either by foldable or detachable when the home is being transported, and attached by suitable securing means when the home has been assembled. A set of stairsteps or ladder (not shown) is used to reach room 56.

Figure 3:
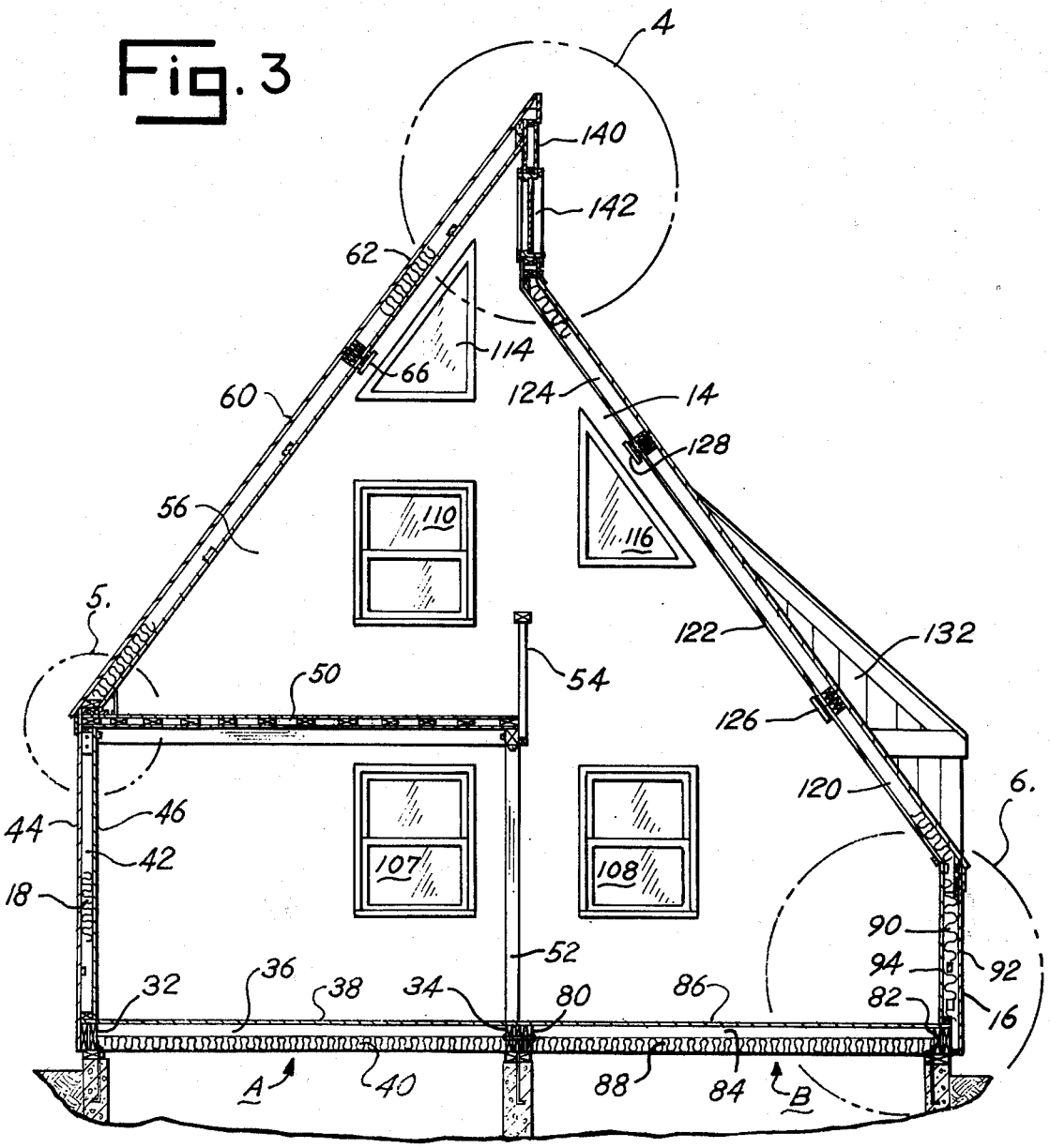
FIG. 3 is a vertical cross sectional view of the home shown in the preceding figures, the section being taken on line 3 — 3 of FIG. 1.
Figure 7:
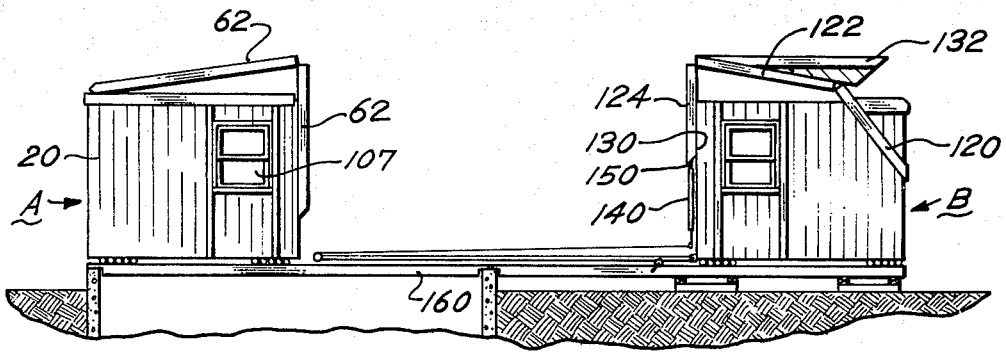
FIG. 7 is an end elevational view of two sections of the present foldable and transportable home, showing the home being located on a permanent foundation.

The roof of section A consists of two longitudinal sections 60 and 62, the lower edge of section 60 being hinged to the upper edge of wall 18 by hinge 64 and the upper edge of the section being joined to the lower edge of section 62 by a hinge 66. The two hinges 64 and 66 are preferably of the piano type hinge, extending the full length of section A. The upper end wall portion 22 is likewise connected to the upper edge of end wall portion 20 by a piano hinge, and when the two end sections 22 are folded inwardly to a substantially horizontal position, i.e. onto floor 50, with rail 54 removed, the two roof sections 60 and 62 can be folded downwardly from the position shonw in FIG. 3 to the position shown in FIG. 7. In the folded position, section 60 approaches horizontal position, and section 62 supported by hinge 66 between the two sections is in a vertical position along the inner side of section A, as seen in FIG. 7, thus permitting section A to be transported conveniently. When the two roof sections 60 and 62 are in their extended position, as seen in FIG. 3, the sections are supported by the end wall portions 22 when they have been pivoted upwardly to their vertical position. Intermediate supports may be used if desired; however, the end walls constitute the primary for the two roof sections.

Longitudinal section B consists of side wall 16, one half of end walls 12 and 14, and the respective half of roof 30, the lower portion 20 of the end walls in this section being joined rigidly to the side wall 16 and the upper portion 22 of the two end walls being hinged to the lower portion 20 to fold inwardly and downwardly. Section B has longitudinal perimeter beams 80 and 82 connected by a plurality of cross members 84 for supporting floor 86. Insulating material 88 may be used in the floor between the cross members in the same manner as insulation 40, and the frame formed by the longitudinal beams and the cross members forms a rigid floor in section B. The side walls are constructed of a plurality of spaced studding 90 supporting outside wall 92 and inside wall 94. In the embodiment illustrated in the drawings, sliding doors 100 and 102 are provided in side 16 and project up into dormers 104 and 106, respectively. Picture windows or other appurtenances may be substituted for one of the two sliding doors if desired. The end walls of the two sections are provided with windows 107 and 108 in the lower portions, and windows 110 and 114 in the upper portion of section A, and windown 116 in the upper portion of section B.

The roof of section B consists of a lower section 120, an intermediate section 122 and an upper section 124, the three sections extending the full length of section A. Roof section 120 is rigidly connected to side wall 16 and the respective two end walls, and remains in fixed position relative thereto. The lower edge of section 122 is pivotally connected by a hinge 126 to the upper edge of section 120 and the lower edge of section 124 is connected to the upper edge of section 122 by a hinge 128, the two hinges 126 and 128 preferably being of the piano type, extending substantially the full length of the respective sections. The upper portions 22 of the end walls of section B fold inwardly and downwardly to a substantially horizontal position, as illustrated in FIG. 7 and upper section 124 extends downwardly from section 122 along the inner side 130 of section B.

Figure 8:
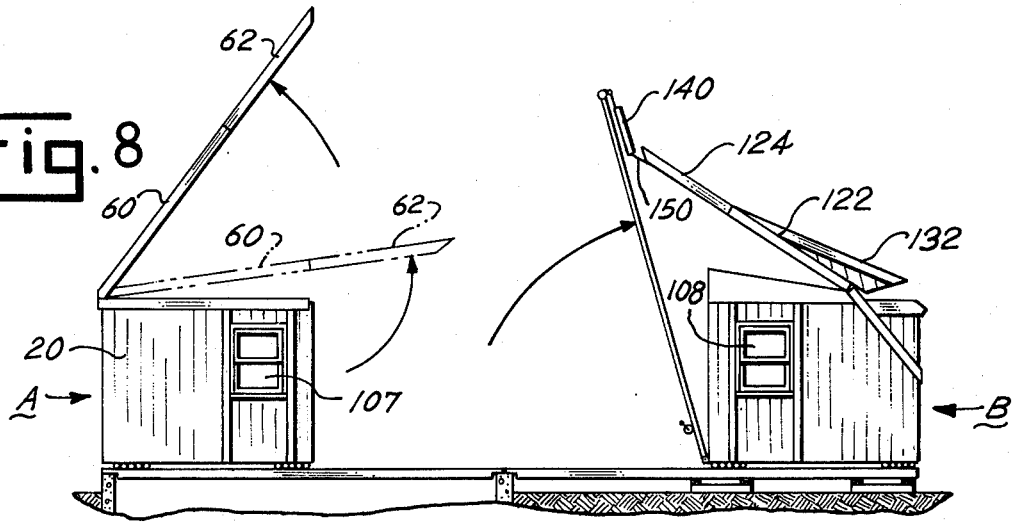
FIG. 8 is an end elevational view illustrating the manner in which the roof of the two sections shown in FIG. 7 is unfolded and prepared for joining with the opposite sections.

The upper parts 132 and 134 of dormers 104 and 106 above the doors 100 and 102 are rigidly attached to intermediate roof section 122 and tilt inwardly and downwardly when the intermediate section is pivoted downwardly, as can be seen in FIGS. 7 and 8. The lower parts 136 and 138 of the two dormers 104 and 106 are attached rigidly to the lower roof section 120 and side wall 16. When the roof is in its extended position, the roof sections are in line with one another and the lower edge of dormer parts 132 and 134 seat on the upper edge of dormer parts 136 and 138, respectively, in sealing relationship so that a tight joint is obtained between the two dormer parts when the roof is in its extended and elevated position.

The elevation of the roof sections of A and B with respect to one another is such that when the two sections are placed together, the upper edge of the roof section of section A is spaced substantially above the upper edge of the roof section of section B, thus providing a space for a vertical wall insert 140 extending the full length of the two sections. This wall insert is provided with a plurality of windows 142 which may be varied in number, size and shape to satisfy design requirements and desires. The windows effectively provide ventilation for room 56, and the wall insert and the offset roofs of the two longitudinal sections A and B create the saw-tooth appearance of the overall structure.

The wall insert 140 may be attached by fixtures or any suitable means to the upper edges of uppermost roof sections 62 and 124, the means used in the embodiment shown in the drawings being removable fasteners attaching the upper edge of the insert to roof section 62 and the lower edge of the insert to section 124. In order to facilitate the assembly of the roof and insert in place, the insert is attached by a plurality of spaced straps 150 to section 124. When the roof of section B is in its folded position, the straps hold the insert in place below roof section 124 along the inner side 130 of section B. The straps also assist in lifting the insert and the roof sections into their elevated position, as illustrated in FIG. 8.

When the foldable and transportable home in the assembled condition, as shown in FIG. 1, is to be moved, the two longitudinal sections A and B are separated from one another, and the upper portions 22 of the ends of the two sections are folded inwardly and downwardly, thus permitting the roof sections 60 and 62 of section A to fold downwardly, after railing 54 has been removed, with roof section 62 extending downwardly from the edge of roof section 60 along the inner side adjacent post or wall 52. In section B, the two roof sections 122 and 124 are folded downwardly, with section 124 extending downwardly along the inner side and with insert 140 suspended on the spaced straps 150 and extending downwardly along the inner side of section B. With the two sections in the folded condition and mounted on an undercarriage, the sections can conveniently be transported on a highway towed by a truck or tractor.

Figure 9:
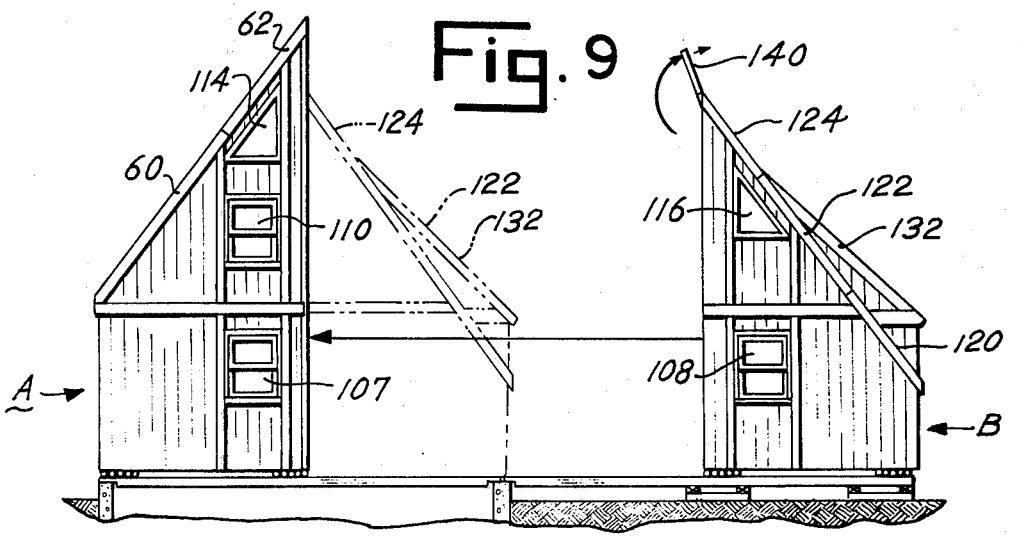
FIG. 9 is an end elevational view further illustrating the manner in which the home is unfolded and the two longitudinal sections joined together.

FIGS. 7, 8 and 9 illustrate the manner in which the two sections A and B are assembled together to form a complete home. While the two sections are separated, the roof sections are elevated from the position shown in FIG. 7 to the position shown in FIG. 8, and upper portions 22 of the two end walls are folded upwardly to a vertical position to support the roof sections. With the roof sections in their extended or elevated positions, the two sections A and B are placed in side-by-side relation. Section A, for example, is first placed on the foundation and section B is placed on skids at the side of the foundation, and by the use of a block and tackle or any other suitable force-multiplying device, section B is moved along the skids or sills 160 until the two sections are juxtaposed, as illustrated in FIG. 9 in full lines for section A and in broken lines for section B. After the two sections A and B have been placed in side-by-side relationship, the two sections are joined rigidly together, and insert 140 is secured in place to close the area between the upper edges of roof sections 62 and 124, the insert being secured rigidly in place by suitable fixtures and sealed along the edges thereof to prevent leakage. The railing 54 is then mounted in place along the edge of floor 50, and the home is substantially completed for occupancy.

While a particular arrangement of doors and windows is illustrated in the drawings, the arrangement may be changed, such as placing doors in one or both ends of the home and windows along the side. Further, one or both dormers may be omitted, and while the roof is shown covered with shingles or shakes and the siding with vertical boards of cedar, other materials may be used for covering both the roof and the sides. Various wall and partition arrangements other than that shown may be used inside the home, and a chimney from a heating system may extend through the roof at a suitable location. The foldable and transportable homes described herein can be used as units in a series of such homes set in end-to-end relation, preferably offset with respect to one another to form a condominium type structure. Both the single and the multiple type may have a carport attached to one side or end and a porch or deck at either end or one or both sides may be added. Various other changes and modifications in the present foldable and transportable home may be made without departing from the scope of the invention.

I claim:

1. A foldable and transportable home comprising two separable longitudinal main sections, a base frame for each section, outside longitudinal side walls and opposite end walls for each main section, each end wall having a lower portion rigidly connected to the respective side wall and an upper portion foldable inwardly and downwardly in the respective section, sloping roof structures for each main section having a plurality of longitudinal sections pivoted to one another on a horizontal line and being foldable downwardly, the upper edge of the uppermost roof section of one of the main sections being spaced above the upper edge of the uppermost roof section of the other main section, said upper edges defining a longitudinally extending space between said uppermost roof sections, and a substantially vertical wall insert disposed in said space.

2. A foldable and transportable home as defined in claim 1 in which the uppermost roof section of each main section extends downwardly from the roof section to which it is joined along the side of the inner edge of the respective main section when said main sections are separated and folded.

3. A foldable and transportable home as defined in claim 1 in which the roof of one of said main sections is provided with a dormer and the side wall extends upwardly thereto and forms a part of the dormer.

4. A foldable and transportable home as defined in claim 3 in which a door is provided in the wall and extension thereof beneath said dormer.

5. A foldable and transportable home as defined in claim 1 in which a lower floor is disposed on said base frame and an upper floor is disposed in one of said main sections, said latter floor being on a level at approximately the junction between the upper and lower portions of said end walls.

6. A foldable and transportable home as defined in claim 2 in which a lower floor is disposed on said base frame and an upper floor is disposed in one of said main sections, said latter floor being on a level at approximately the junction between the upper and lower portions of said end walls.

7. A foldable and transportable home as defined in claim 6 in which a means supports said wall insert below one of said uppermost sections when said uppermost section is in its folded down position along the inner side of the respective section.

8. A roof structure as defined in claim 1 in which the roof portion having the higher upper edge consists of two longitudinal sections joined together by hinge means and the other of said roof portions consists of three roof sections joined together by hinge means, and the lowermost roof section of the latter roof portion is secured to the respective side and end walls.

9. In a foldable and transportable home, a roof structure having two sloping roof portions, each of said portions having longitudinal sections foldable relative to one another, the uppermost section of one of said roof portions being spaced above the upper edge of the uppermost roof section of the other roof portion, thereby defining a longitudinally extending space between said uppermost roof sections and a substantially vertical wall insert disposed in said space between said upper edges.

10. A roof structure as defined in claim 9 in which said wall insert contains a plurality of windows.

11. A roof structure as defined in claim 9 in which said insert is connected to one of said uppermost roof sections by a plurality of flexible members.

12. A roof structure as defined in claim 9 in which the roof portion having the higher upper edge consists of two longitudinal sections joined together by hinge means and the other of said roof portions consists of three roof sections joined together by hinge means, and the lowermost roof section of the latter roof portion is secured to the respective side and end walls.

* * * * *